US008939600B1

(12) United States Patent
Beadle et al.

(10) Patent No.: US 8,939,600 B1
(45) Date of Patent: Jan. 27, 2015

(54) LANDSCAPE DOWN LIGHT FIXTURE CONFIGURED FOR WATER DRAINAGE

(75) Inventors: Joshua Z. Beadle, San Diego, CA (US); Darrin I. Schmuckle, Vista, CA (US)

(73) Assignee: Hunter Industries, Inc., San Marcos, CA (US)

( * ) Notice: Subject to any disclaimer, the term of this patent is extended or adjusted under 35 U.S.C. 154(b) by 152 days.

(21) Appl. No.: 13/396,427

(22) Filed: Feb. 14, 2012

(51) Int. Cl.

| | |
|---|---|
| ***F21L 4/00*** | (2006.01) |
| ***F21V 33/00*** | (2006.01) |
| ***F21V 21/26*** | (2006.01) |
| ***F21V 19/02*** | (2006.01) |
| ***F21V 21/30*** | (2006.01) |
| ***F21L 19/00*** | (2006.01) |
| ***F21V 11/00*** | (2006.01) |
| ***F21V 29/00*** | (2006.01) |

(52) U.S. Cl.
USPC ..... 362/158; 362/96; 362/269; 362/285; 362/287; 362/177; 362/353; 362/267

(58) Field of Classification Search
CPC ..... F21V 23/00; F21V 15/01; F21V 31/03; F21V 31/005; F21W 2131/10; F21W 2131/109; F21W 2121/02; F21S 48/215
USPC ..... 362/145, 149, 158, 171, 177, 178, 197, 362/277, 282, 285, 287, 319, 393, 418, 101, 362/96, 153.1, 269, 427, 429, 267, 294, 362/373, 356, 353
See application file for complete search history.

(56) References Cited

U.S. PATENT DOCUMENTS

| | | | | |
|---|---|---|---|---|
| 4,180,850 | A * | 12/1979 | Bivens | 362/285 |
| 5,599,091 | A * | 2/1997 | Kira | 362/269 |
| 5,649,760 | A | 7/1997 | Beadle | |
| 6,357,892 | B1 | 3/2002 | Beadle | |
| 6,422,717 | B1 | 7/2002 | Beadle | |
| 6,491,407 | B1 | 12/2002 | Beadle | |
| 6,612,720 | B1 | 9/2003 | Beadle | 362/287 |
| 6,752,516 | B1 | 6/2004 | Beadle | |
| 6,779,907 | B2 | 8/2004 | Beadle | 362/145 |
| 6,796,684 | B1 | 9/2004 | Beadle | |
| 6,799,869 | B1 | 10/2004 | Beadle | |
| 6,874,905 | B1 | 4/2005 | Beadle | 362/153.1 |
| 6,902,200 | B1 | 6/2005 | Beadle | 285/185 |
| 7,320,533 | B1 | 1/2008 | Beadle | |
| 7,387,409 | B1 | 6/2008 | Beadle | 362/308 |

(Continued)

OTHER PUBLICATIONS

UL1598 cover page and p. 13, dated Dec. 30, 2004.

*Primary Examiner* — Peggy Neils
*Assistant Examiner* — William N Harris
(74) *Attorney, Agent, or Firm* — Knobbe Martens Olson & Bear LLP

(57) ABSTRACT

A down light fixture that is suitable for installation on building structures and around lawns and gardens of residential and commercial properties for providing aesthetically pleasing illumination and security illumination. The down light fixture includes a body having a hollow interior and a circuit board mounted in the hollow interior. A transparent cover extends across a lower end of the body. A wire extends through a pivotable mounting device secured to an upper end of the body and through a potting cup to the circuit board for carrying electrical power to a source of illumination. The body is formed with a drain port located so that any water that accumulates in the interior of the body when the body is in a downwardly directed orientation will drain from the body before it can reach an upper end of the potting cup.

10 Claims, 4 Drawing Sheets

(56) References Cited

U.S. PATENT DOCUMENTS

| | | | | |
|---|---|---|---|---|
| 7,520,644 | B2 * | 4/2009 | Jordan et al. | 362/477 |
| 7,712,925 | B2 * | 5/2010 | Russell | 362/294 |
| 7,874,709 | B1 | 1/2011 | Beadle | 362/365 |
| 7,993,040 | B2 | 8/2011 | Beadle | |
| 8,602,613 | B2 | 12/2013 | Pike et al. | |
| 2001/0014021 | A1 * | 8/2001 | Duff et al. | 362/268 |
| 2004/0120141 | A1 | 6/2004 | Beadle | |
| 2005/0174774 | A1 * | 8/2005 | Lunt | 362/267 |
| 2009/0154164 | A1 * | 6/2009 | Hsu et al. | 362/267 |
| 2011/0255293 | A1 * | 10/2011 | Lipscomb et al. | 362/362 |

* cited by examiner

LANDSCAPE DOWN LIGHT FIXTURE CONFIGURED FOR WATER DRAINAGE

FIELD OF THE INVENTION

The present invention relates to light fixtures, and more particularly, incandescent and LED light fixtures designed for installation on building structures and on other structures located around lawns and gardens of residential and commercial properties.

BACKGROUND OF THE INVENTION

Outdoor landscape lighting is popular for security, aesthetic, safety, and other reasons. For many years outdoor landscape light fixtures have incorporated incandescent light bulbs. Recent advances in light emitting diode (LED) technology have led to an increased demand for improved landscape light fixtures that utilize more reliable and more energy efficient high intensity LEDs.

Various types of commercial landscape light fixtures are available to meet the particular needs of residential or commercial properties. These include path, down, deck, tree, spot, spread, and security light fixtures. Down light fixtures, also referred to as "downlighting" or "moonlighting", are outdoor landscape light fixtures that are designed to place the illuminating source above the target area. Down light fixtures can be used to illuminate specific garden elements for aesthetic appeal, or to illuminate pedestrian areas and large specific spaces for safety, security or recreational purposes.

Outdoor landscape light fixtures are exposed to rainfall and, not infrequently, to water sprayed by irrigation systems. Down light fixtures, as the name suggests, are pointed downwardly, and therefore have special waterproofing issues.

SUMMARY OF THE INVENTION

The present invention provides a down light fixture for installation on building structures and on other structures located around lawns and gardens of residential and commercial properties. The down light fixture includes a body having a hollow interior and a circuit board mounted in the hollow interior. A source of illumination is mounted on the circuit board. A pivotable mounting device is secured to an upper end of the body and is configured to enable directional orientation of the body. A potting cup inside the hollow interior extends between the pivotable mounting device and the circuit board. A transparent cover extends across a lower end of the body. A wire extends through the pivotable mounting device and the potting cup to the circuit board for carrying electrical power to the source of illumination. The body is formed with a drain port located so that any water that accumulates in the interior of the body when the body is in a downwardly directed orientation will drain from the body before it can reach an upper end of the potting cup.

DETAILED DESCRIPTION

Figure 1:
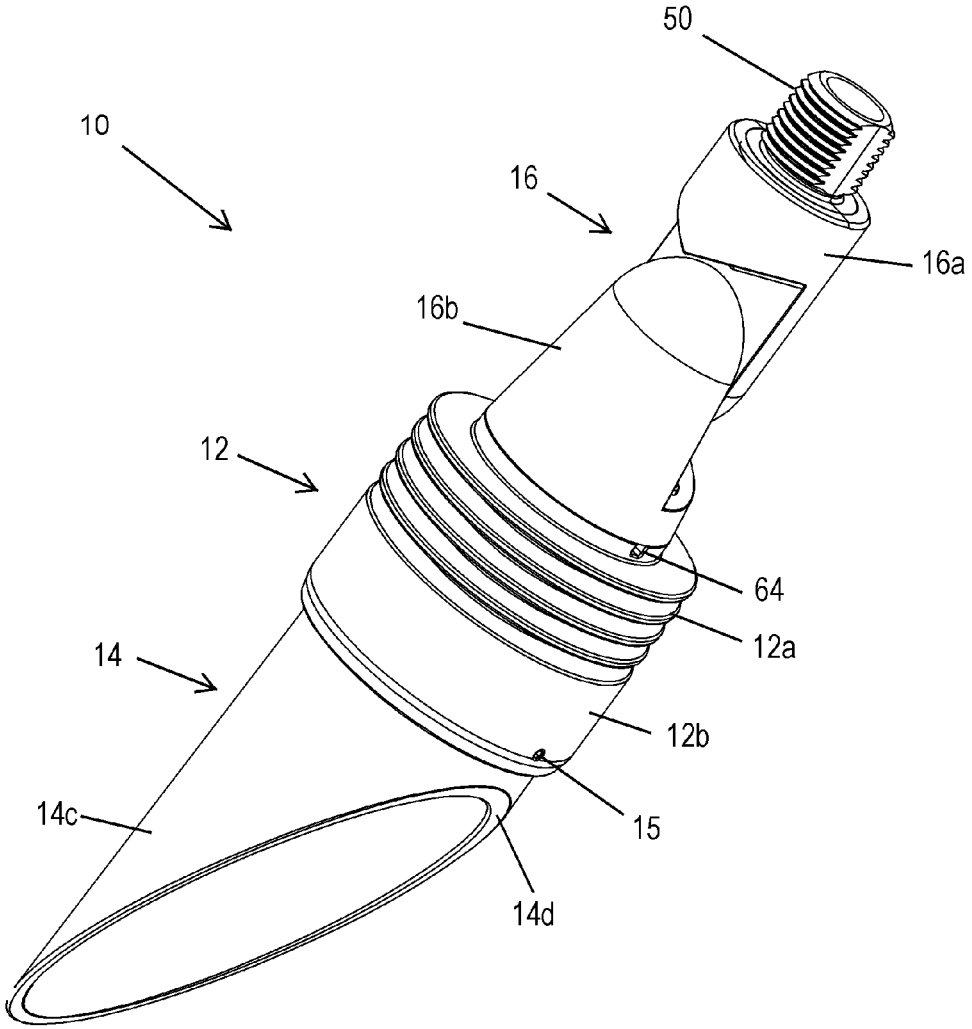
FIG. 1 is an isometric side elevation view of a down light fixture in accordance with an embodiment of the present invention.

FIG. 1 illustrates a down light fixture 10 in accordance with an embodiment of the present invention. The down light fixture 10 includes a cylindrical body 12 defining a hollow interior that encloses electrical components, a tapered shroud 14 slip fit and secured by a set screw 15 into a lower end of the cylindrical body 12 that directs and confines the emitted light, and a pivotable mounting device in the form of a knuckle joint assembly 16 attached to an upper end of the cylindrical body 12. The foregoing components are preferably machined from cast Aluminum alloy parts for durability. An anodized coating is preferably applied to the exterior of the machined Aluminum alloy parts to prevent oxidation and to provide an aesthetically appealing finish. These components can also me made of other suitable metals such as brass alloy, Aluminum, Copper, etc. Some or all of them can be molded out of suitable plastic, however, a material with high thermal conductivity is preferred for the cylindrical body 12 so that this component can facilitate the dissipation of heat generated by the source of illumination contained therein. An upper segment of the exterior of the cylindrical body 12 is provided with an integral heat sink in the form of a plurality of spaced-apart radially and circumferentially extending ribs 12*a*.

Figure 2:
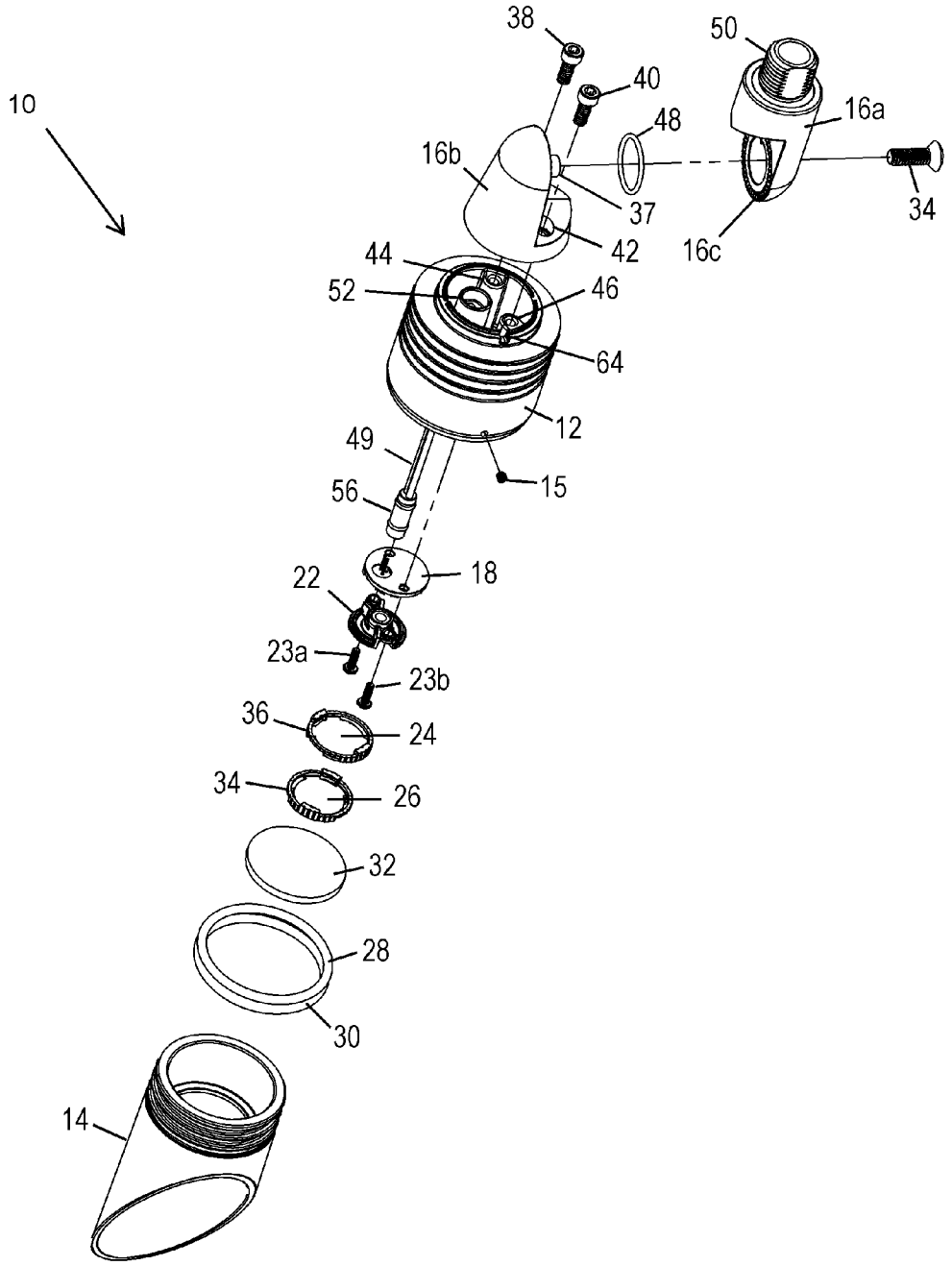
FIG. 2 is a slightly reduced, exploded isometric view of the down light fixture of FIG. 1.

Referring to FIG. 2, a disc-shaped LED luminary printed circuit board (PCB) 18 is mounted inside the cylindrical body 12. The luminary PCB 18 supports a high intensity LED 20 (FIG. 3) and provides a conductive path to the electrical power. The luminary PCB 18 is readily replaceable in the event of a failure of the LED 20. The down light fixture 10 may have a single LED and a PCB formed with electrically conductive paths for power connection and without other electronic components. Alternatively, the down light 10 may be of the intelligent LED type disclosed in U.S. patent application Ser. No. 12/564,840 filed Sep. 22, 2009 by Peter J. Woytowitz entitled "Low Voltage Outdoor Lighting Power Source and Control System" and published Apr. 8, 2010 under Publication No. US-2010-0084985-A1, or U.S. patent application Ser. No. 13/244,869 filed Sep. 26, 2011 by Peter J. Woytowitz entitled "Systems and Methods for Providing Power and Data to Lighting Devices," now U.S. Pat. No. 8,278,845; the entire disclosures of which are hereby incorporated by reference. Said applications are assigned to Hunter Industries, Inc., the assignee of the subject application. The down light fixture 10 can have red, green and blue LEDs and can be connected to the aforementioned power source and control system in order to generate different lighting effects such as variable color and intensity in a reliable and energy efficient manner.

U.S. Publication '985 provides examples of a power source and control system that rectify line voltage AC into a low voltage to be provided to a light fixture. For example, according to some embodiments, line voltage AC is rectified into a first high DC voltage. This first DC voltage is switched by a first switching circuit to create a high frequency AC voltage. The high frequency AC voltage is coupled through a transformer for isolation and step-down purposes. Because the frequency is high, the transformer is small and light compared to a 50/60 Hz transformer. The output of the transformer is rectified and filtered to produce a low voltage (12V) DC signal. The 12VDC signal is fed into a second switching circuit in the form of an H-bridge circuit that generates a low frequency AC signal with data periodically encoded at a high frequency. The low frequency AC signal is transmitted to the lighting fixtures via the buried power conductors.

As discussed in U.S. Patent '845, a low voltage power signal between approximately 11VAC and 14VAC, or of approximately 12VAC, or of approximately 24VAC, may be used to power the down light fixture 10.

Figure 3:
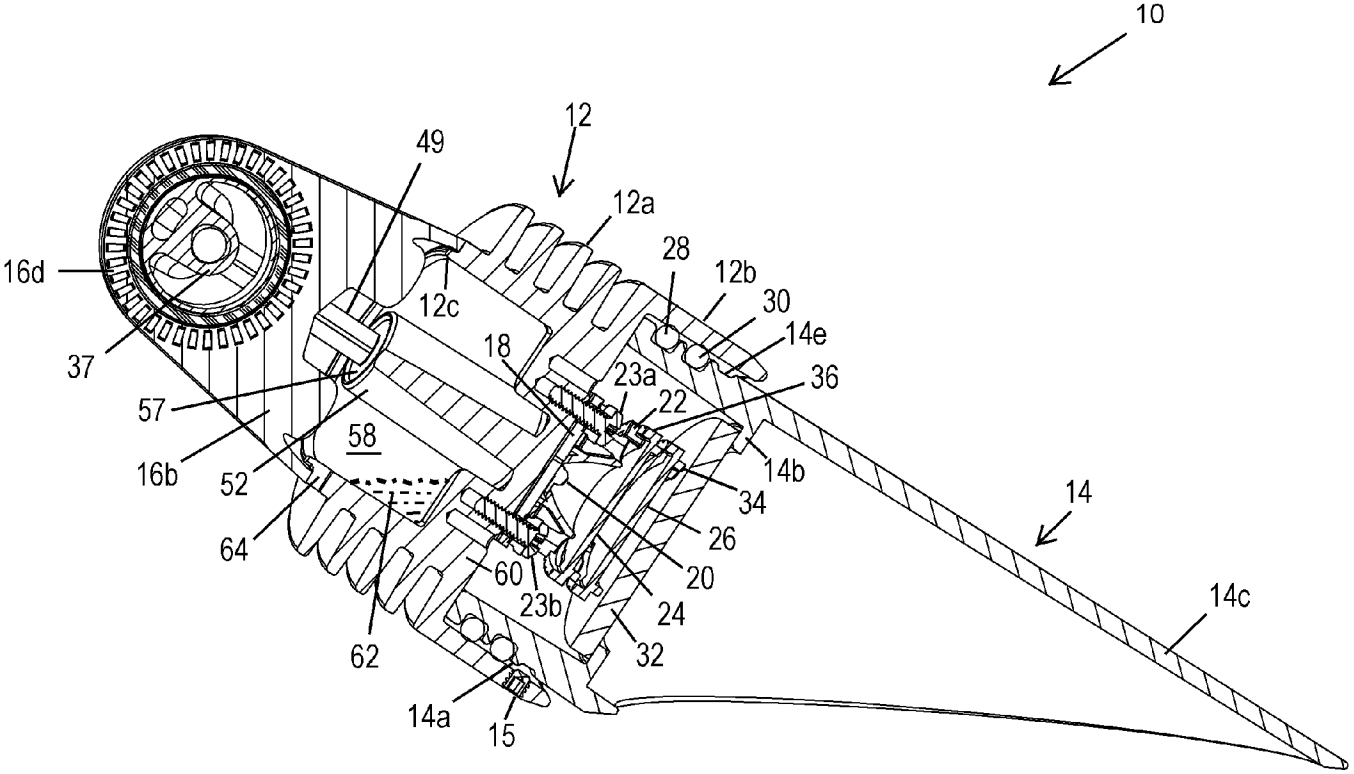
FIG. 3 is a longitudinal sectional view of the down light fixture of FIG. 1.

Referring still to FIG. 3, a parabolic reflector 22 surrounds the LED 20 so that the LED 20 is located at the approximate focus of the reflector 22 which gathers and forwardly directs the light emitted by the LED 20 in a predetermined desired pattern to the target area. The inner end of the reflector 22 is secured to the cylindrical body 12 with a pair of machine screws 23*a* and 23*b* (FIG. 2). The luminary PCB 18 is securely sandwiched between the reflector 22 and the cylindrical body 12 Referring to FIGS. 2 and 3, a disc-shaped color filter 24 and a disc-shaped diffuser 26 are mounted over the LED 20 and reflector 22. The diffuser 26 softens the intensity of the light emitted by the LED 20 as perceived by an observer's naked eye.

Figure 4:
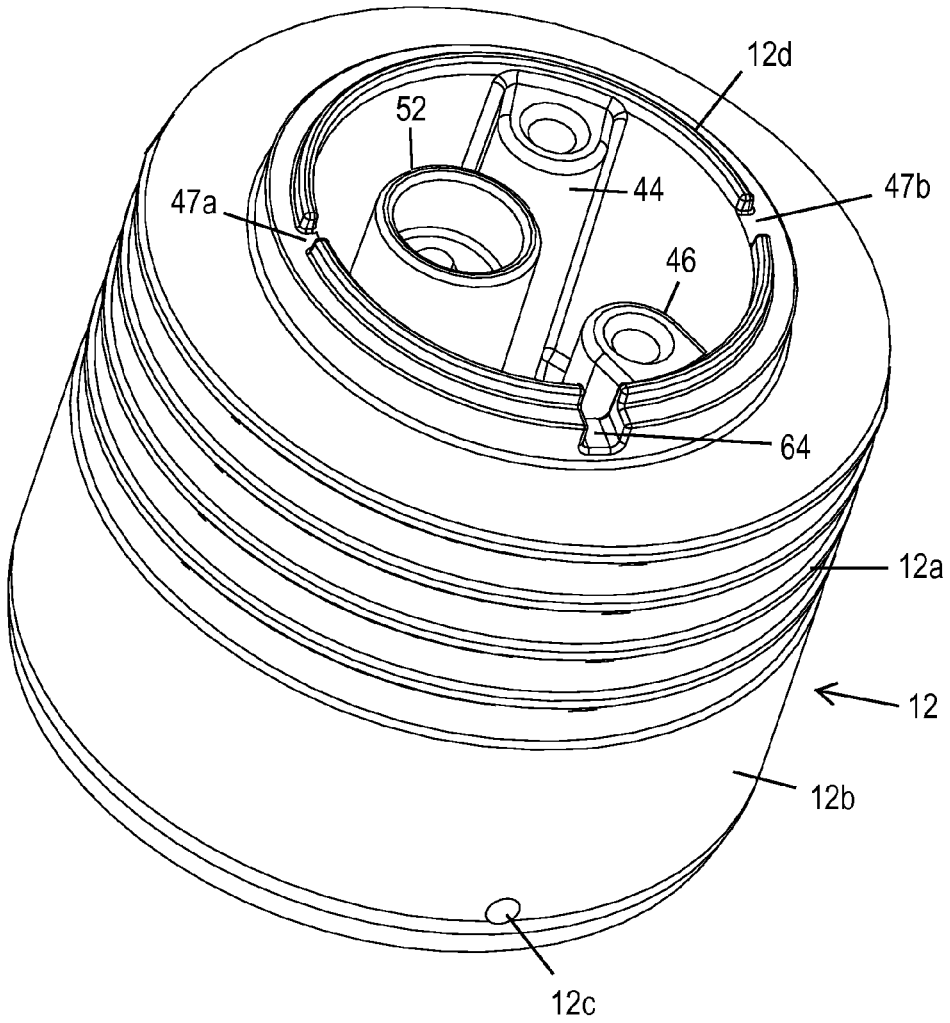
FIG. 4 is an enlarged isometric side elevation view of the cylindrical body of the down light fixture of FIG. 1 with its knuckle joint assembly removed.

An upper cylindrical segment 14*a* (FIG. 3) of the shroud 14 removably slips into the lower segment 12*b* of the cylindrical body 12. The female-to-male overlap of the lower body segment 12*b* with the upper cylindrical segment 14*a* of the shroud helps prevent entry of water into the cylindrical body 12. Additionally, entry of water into the cylindrical body 12 is further impeded by a pair of O-rings 28 and 30 made of a suitable elastomeric material that are seated in annular grooves formed in the exterior of the upper cylindrical segment 14*a* of the shroud 14 and are squeezed between the cylindrical body 12 and the shroud 14. The set screw 15 is threaded into a threaded hole 12*c* (FIG. 4) that is formed in the lower body segment 12*b* and is tightened against an annular groove 14*e* formed on the outer surface of upper cylindrical segment 14*a* to hold the shroud 14 securely in position both axially and radially.

A disc-shaped protective transparent cover 32 extends across the diffuser 26 and provides an optical path for light to leave the down light fixture 10. By way of example, the transparent cover 32 can be made of glass, high temperature resistant plastic, or scratch resistant sapphire. On one side of the transparent cover 32 a periphery of the transparent cover 32 engages the interior of a circular flange 14*b* that projects radially inwardly from the upper cylindrical segment 14*a* of the shroud 14. A circular frame 36 supports the color filter 24. The circular frame 36 carries the circular frame 34 and the diffuser 26. The circular frame 36 and the color filter 24 are in turn supported by the reflector 22. When the shroud 14 is screwed into the cylindrical body 12, the shroud 14, O-rings 28 and 30, and the transparent cover 32 seal off a lower portion of the hollow interior of the cylindrical body 12 and protect the luminary PCB 18 and the LED 20.

The knuckle joint assembly 16 (FIG. 1) includes a base knuckle 16*a* and a top knuckle 16*b* that are pivotally connected by a machine bolt 34 (FIG. 2). The male threaded distal end of the machine bolt 34 is screwed into a transversely extending female threaded sleeve 37 (FIG. 3) formed in the top knuckle 16*b* to pivotally connect the base knuckle 16*a* and the top knuckle 16*b*. The top knuckle 16*b* is secured to the upper end of the cylindrical base 12 with a pair of machine bolts 38 and 40 (FIG. 2) that pass through a pair of side-by-side bores 42 formed in the top knuckle 16*b*. The male threaded distal ends of the bolts 38 and 40 are screwed into axially extending female threaded sleeves 44 and 46 (FIG. 4) formed in the top of the cylindrical body 12.

The upper end of the cylindrical body 12 is formed with a circular mounting flange 12*d* (FIG. 4) which mates with a shoulder (not visible) of the top knuckle 16*b* as best seen in FIG. 3. A pair of diametrically opposed slots 47*a* and 47*b* formed in the mounting flange 12*d* receive corresponding projections (not illustrated) on the top knuckle 16*b* to rotationally align the top knuckle 16*b* and the cylindrical body 12 during assembly.

An O-ring 48 (FIG. 2) made of a suitable elastomeric material is seated in a pair of opposing circular grooves formed in the base knuckle 16*a* and the top knuckle 16*b*. The O-ring 48 helps to seal the knuckle joint assembly 16 against the unwanted intrusion of water. A plurality of radially extending teeth 16*c* formed in the circular face surface of the top knuckle 16*b* mate with and fit between a plurality of radially extending teeth 16*d* (FIG. 3) formed on the mating circular face of the base knuckle 16*a* to prevent unwanted slippage then the machine screw 34 is tightened. This arrangement permits the angle of the top knuckle 16*b* to be adjusted relative to the base knuckle 16*a* when the machine screw 34 has been loosened enough to allow the teeth 16*c* and 16*d* to pass by each other.

The base knuckle 16*a* and the top knuckle 16*b* are formed with recesses or grooves (not illustrated) that create a passageway. This passageway provides a conduit that allows a twin conductor insulated wire 49 (FIG. 2) to pass through a hollow male threaded shank 50 of the base knuckle 16*a* and through the top knuckle 16*b*. The wire 49 then passes through an axially extending cylindrical hollow potting cup 52 (FIG. 4) formed in the cylindrical base 12. The potting cup 52 is located inside the hollow interior of the cylindrical base 12 and provides a tubular conduit that extends between the knuckle joint assembly 16 and the luminary PCB 18. The passageway that extends through the base knuckle 16*a* and the top knuckle 16*b* is dimensioned and configured to allow the wire 49 to traverse the interior of the knuckle joint assembly 16 without binding or chafing while still allowing the knuckle joint assembly 16 to be pivotally adjusted to change the angle of illumination provided by the down light fixture 10. The proximal end of the wire 49 (not illustrated) extends a sufficient distance from the down light fixture 10 to facilitate operative connection of the conductors in the wires 49 to the terminals of the power source and control system. Additionally, the knuckle assembly 16 may be of the type found in U.S. Pat. No. 6,902,200 granted Jun. 7, 2005 to Joshua Beadle and entitled "Contaminant-Resistant Pivot Joint for Outdoor Lighting Fixture", the entire disclosure of which is hereby incorporated by reference. The aforementioned patent is also assigned to Hunter Industries, Inc.

The male threaded shank 50 (FIG. 2) of the knuckle joint assembly 16 can be screwed into a bracket (not illustrated) that can in turn be secured with wood screws or bolts to a beam or overhang of a building or to a structure such as a trellis or gazebo located in a lawn or garden. Typically the bracket would be secured to an overhead member so that the central longitudinal axes of the cylindrical base 12 and the shroud 14 are pointed in a downward direction. The down light fixture 10 can thus illuminate the target area below the down light fixture. The beveled lower portion 14*c* (FIG. 1) of the shroud 14 is preferably oriented so that a peripheral oval-shaped lip 14*d* thereof faces downwardly. In the preferred orientation, a plane that passes through the peripheral lip 14*d* is substantially perpendicular to a plane normal to the axis of rotation of the knuckle joint assembly 16 defined by the bolt 34 (FIG. 2). The set screw 15 (FIG. 3) fixes the rotational position of the shroud 14 relative to the cylindrical body 12 when it is tightened.

The luminary PCB 18 (FIGS. 2 and 3) has two conductive male pins made of metal that mate with corresponding metal contacts of a female electrical socket 56 (FIG. 2) operatively connected to the distal end of the wire 49. During assembly of the down light fixture 10 the wire 49 is potted inside the bore of the potting cup 52 with a predetermined quantity 57 of a suitable potting compound such as Part No. 041108-FC-4 from Ellsworth Adhesives. When the quantity of potting compound 57 cures, the potting compound 57 inside the potting cup 52 provides a substantially water tight seal between the wire 49 and an interior wall of the potting cup 52. The wire 49 is permanently potted and sealed in an effort to prevent water intrusion from the upper end of the cylindrical body 12 into the lower portion of the interior of the cylindrical body 12 where it might reach the luminary PCB 18, causing a short or damage to the LED 20. The upper portion of the hollow interior of the cylindrical body 12 includes a reservoir or cavity 58 (FIG. 3) through which the potting cup 52 extends. The cavity 58 is separated from the lower portion of the hollow interior of the cylindrical body 12 that contains the luminary PCB 18 by a transverse wall 60. The lower end of the potting cup 52 is integrally formed with the transverse wall 60 and the bore that extends through the potting cup 52 communicates with a hole formed in the transverse wall 60. This arrangement allows the electrical socket 56 to be pushed over the pair of metal pins that extend from the luminary PCB 18.

Due to the normal inclined orientation of the down light 10 at a typical angle as illustrated in FIG. 3, a small quantity of water 62 can accumulate in the cavity 58. A slot 64 (FIG. 4) formed in the circular mounting flange 12*d* of the cylindrical body 12 provides a drain port. This drain port is rotationally oriented so that it is on the low side of the down light fixture 10. The upper end of the potting cup 52 is higher in reference to the longitudinal axis of the down light fixture 10 than the drain port. The size of the drain port is sufficient so that the water 62 will always drain out of the cylindrical body 12 via the drain port before it reaches the upper end of the quantity of potting compound 57. This prevents the water from standing on top of the potting compound 57 and seeping down through the potting cup 52 to the luminary PCB 18. This is true even if the down light fixture 10 is mounted with its longitudinal axis completely vertical.

While an embodiment of a down light fixture has been described in detail, it will be understood by those skilled in the art, based on the description herein, that the present invention can be modified in both arrangement and detail. For example, the source of illumination could be an incandescent bulb instead of an LED. See U.S. Pat. No. 6,784,905 granted Apr. 5, 2005 to Joshua Z. Beadle or U.S. Pat. No. 7,387,409 granted Jun. 17, 2008 to Joshua Z. Beadle, the entire disclosures of which are hereby incorporated by reference. Said patents are also assigned to Hunter Industries, Inc. The down light fixture 10 could be designed to work with the lighting controller disclosed in pending U.S. patent application Ser. No. 13/189,718 filed on Jul. 25, 2011 by Peter J. Woytowitz entitled "Programmable Landscape Lighting Controller with Self-Diagnostic Capabilities and Fail Safe Features", the entire disclosure of which is hereby incorporated by reference. Said application is also assigned to Hunter Industries, Inc. Therefore, the protection afforded the present invention should only be limited in accordance with the scope of the following claims.

What is claimed is:

1. A light fixture, comprising:

a body having a first end, a second end, and an outer wall defining a hollow interior;

a circuit board mounted in the hollow interior of the body;

a source of illumination mounted on the circuit board;

a mounting device secured to the body;

a tubular conduit located inside the hollow interior, the tubular conduit having a longitudinal axis, a first end, and a second end, the second end of the tubular conduit positioned closer to the source of illumination than the first end of the tubular conduit;

a transparent cover that extends across the second end of the body;

a wire extending through the mounting device and the tubular conduit to the circuit board for carrying electrical power to the source of illumination; and the body being formed with a drain port in the outer wall of the body, at least a portion of the drain port positioned between the source of illumination and the first end of the tubular conduit as measured along the longitudinal axis of the tubular conduit.

2. The light fixture of claim 1 wherein the mounting device includes a knuckle joint assembly.

3. The light fixture of claim 1, further comprising a light confining shroud mounted to the second end of the body, the light confining shroud having a short side opposite a long side which forms a beveled end defining an outlet of the light confining shroud, and wherein the drain port is on a same side of the light fixture as the short side of the light confining shroud.

4. The light fixture of claim 3 wherein the body has a cylindrical configuration and the shroud is secured into the second end of the body with a screw.

5. The light fixture of claim 4 wherein a portion of the cylindrical body overlaps the shroud to prevent water from traveling into the interior of the body.

6. The light fixture of claim 1 and further comprising a predetermined quantity of a potting compound inside the tubular conduit that provides a substantially water tight seal between the wire and an interior wall of the tubular conduit.

7. The light fixture of claim 1 wherein the source of illumination is an LED.

8. The light fixture of claim 1 wherein the body further comprises an internal wall which separates the hollow interior into a first chamber with the drain port and a second chamber with the source of illumination.

9. The light fixture of claim 1 wherein the drain port is located at the first end of the body.

10. A light fixture comprising:

a body having:

an outer wall defining a hollow interior of the body;

a transverse wall dividing the hollow interior into a first cavity and a second cavity;

a first end; and a second end;

a shroud connected to the second end of the body;

a source of illumination mounted in the second cavity;

a mounting device secured to the body;

a tubular conduit inside the hollow interior extending from the transverse wall into the first cavity, the tubular conduit having a first end in the first cavity;

a transparent cover that extends across the second end of the body;

a wire extending through the mounting device and the tubular conduit; and a drain port positioned in the outer wall of the body between the transverse wall and the first end of the tubular conduit.

* * * * *